US008397613B2

(12) United States Patent
Skurdal et al.

(10) Patent No.: US 8,397,613 B2
(45) Date of Patent: Mar. 19, 2013

(54) ADAPTABLE LAUNCHING SYSTEM

(75) Inventors: Daniel A. Skurdal, Joppa, MD (US); Timothy R. Fouts, Washington, DC (US); Jennifer L. Houston-Manchester, Baldwin, MD (US); John Snediker, Felton, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 359 days.

(21) Appl. No.: 12/274,409

(22) Filed: Nov. 20, 2008

(65) Prior Publication Data

US 2009/0126556 A1 May 21, 2009

Related U.S. Application Data

(60) Provisional application No. 60/989,396, filed on Nov. 20, 2007.

(51) Int. Cl.
*F41F 3/04* (2006.01)

(52) U.S. Cl. ..... 89/1.817

(58) Field of Classification Search ..... 89/1.8, 89/1.817, 1.81, 1.816, 1.813
See application file for complete search history.

(56) References Cited

U.S. PATENT DOCUMENTS 3,089,389 A * 5/1963 Andrews et al. ..... 89/1.816
3,106,132 A * 10/1963 Biermann et al. ..... 89/1.815
3,110,464 A 11/1963 Baratoff et al.
3,468,213 A * 9/1969 Hersh et al. ..... 89/1.8
4,586,421 A * 5/1986 Hickey et al. ..... 89/1.81
4,646,617 A * 3/1987 Robinson ..... 89/1.81
4,665,792 A * 5/1987 Gassler et al. ..... 89/1.816
5,327,809 A 7/1994 Matteson et al.
5,742,609 A * 4/1998 Kondrak et al. ..... 370/465
6,125,734 A * 10/2000 Yagla ..... 89/1.816
6,142,055 A * 11/2000 Borgwarth et al. ..... 89/1.817
6,230,604 B1 5/2001 Larson et al.
6,283,005 B1 9/2001 Yagla et al.
6,610,971 B1 * 8/2003 Crabtree ..... 244/3.1
2002/0189432 A1 12/2002 Facciano et al.
2005/0108917 A1 5/2005 Kunstmann
2009/0126556 A1 5/2009 Skurdal et al.

OTHER PUBLICATIONS

"BAE Systems MK25 Quad Pack", "http://web.archive.org/web/20071018171337/http://baesystenns.com/ ProductsServices/mk25_quad_pack.html XP002545342", Oct. 18, 2007, Publisher: BAE Systems.

Moorhead, Seth B., "The Latest in Ship Weapon Launchers—The Vertical Launching System", "Naval Engineers Journal XP002048251", Apr. 1981, pp. 90-96, vol. 93, No. 2, Published in: US.

Beaufume, Cedric, "PCT Application No. PCT/US2008/084115 International Search Report Oct. 1, 2009", , Publisher: EPO, Published in: EP.

Menier, Renan, "PCT Application No. PCT/US2011/047045 International Search Report Nov. 7, 2011", , Publisher: PCT, Published in: PCT.

Albuquerque, Savio, "AU Application No. 2008351349 Office Action Feb. 11, 2011", , Publisher: IPA, Published in: AU.

Giffo-Schmitt, Beate, "PCT Application No. PCT/US2008/084115 International Preliminary Report on Patentability Jul. 3, 2010", , Publisher: PCT, Published in: PCT.

Evans, David J., "GB Application No. 1009887.9 Office Action Mar. 26, 2012", , Publisher: UK IPO, Published in: GB.

* cited by examiner

*Primary Examiner* — Michael Carone
*Assistant Examiner* — Reginald Tillman, Jr.
(74) *Attorney, Agent, or Firm* — Kaplan Breyer Schwarz & Ottesen, LLP

(57) ABSTRACT

A launch system for use as a standalone munition launcher or as a guest launcher within a main battery host launcher.

18 Claims, 4 Drawing Sheets

ADAPTABLE LAUNCHING SYSTEM

STATEMENT OF RELATED CASES

This case claims priority of U.S. Provisional Patent Application Ser. No. 60/989,396 filed Nov. 20, 2007 and which is incorporated herein by reference.

FIELD OF THE INVENTION

The present invention relates to missile launchers, and more particularly to vertical missile launchers.

BACKGROUND OF THE INVENTION

Modern warships use guided missiles as their principal offensive and defensive weapons. Since a naval engagement may be protracted, a warship must have many missiles available for immediate launch. This need has been addressed by multiple-missile launchers, in which plural launch cells (e.g., eight cells, etc.) are loaded with missiles that can be individually launched.

There is also a need to launch, from a single multiple-missile launcher, missiles of different mission type. This need has been met, for example, by the below-deck, vertical Mk41 and Mk57 missile launchers. These launchers accept canisterized missiles, wherein the missiles in the canister can be one of several types. The canisters are loaded into corresponding canister-holding chambers or cells in the missile launcher. Each canisterized missile has a standardized connector, which is connected within each cell, to a launch sequencer. The launch sequencer is an electronic assembly that identifies the missile within the canister by interrogating a code that is associated with the canister. The launch sequencer also responds to arming and firing signals from a higher level of control by generating a sequence of signals for the identified missile (e.g., firing signals, safe signals, etc.). These signals are transmitted via an umbilical cable to the canister and the missile within it to control launch.

A major road block to providing new munitions capability to naval fleets is the extremely high cost of launcher-related modifications. Specifically, integration of a new munition into an existing main battery launching system typically requires the design and qualification of a new canister for packaging, handling, storing, and transporting the munition. Furthermore, existing main battery host-launcher electronics and software must be appropriately modified to provide power and interfacing to each of the munition rounds in the newly developed canister. Additionally, integrating a new munition typically requires requalifying the gas management system of the launcher for the new munition.

It would therefore be beneficial to develop a way to reduce the cost for integrating new munitions in existing main-battery launchers.

SUMMARY OF THE INVENTION

The illustrative embodiment of the present invention is a single-cell, vertical launching system (hereinafter "adaptable launch system" or "ALS") for new and existing munitions.

In some embodiments, the ALS is used as a standalone launcher. In some other embodiments, the ALS is used as a "guest" launcher in one or more cells of a multi-cell "host" launching system, such as the Mk41 or Mk57 VLS main-battery launchers. In both standalone and guest-launcher applications, the ALS can accommodate either a single munition or a "multi-pack" of smaller munitions in its single launch cell.

It is particularly in its capacity as a guest launcher that the ALS addresses the problems associated with the integration of new munitions into an existing main battery launching system. In this regard, the ALS is not analogous to a canistered round, such would be received in a cell of a Mk41 or Mk57 launcher. Rather, the ALS contains and acts with most of the functionality required for launch. The ALS itself receives one or more canistered munitions in its removable "munitions adapter." Providing multiple versions of the "munitions adapter" enables the ALS to accommodate different types of munitions. The ALS advantageously uses existing, qualified canisters and munitions without the need for modification. This is done by reutilizing in the ALS, to the extent possible, mechanical and electrical hardware, software, and logistics developed from earlier applications. As a consequence, a one-time modification is required to existing main battery launchers to adapt to the presence of the ALS, establishing the "guest"/"host" launcher functionality. Integration/adaptation specifics pertaining to the munitions are handled within the ALS itself.

In summary, the following features of the ALS contribute to its utility, at least in terms of providing developmental and recurring costs savings:

- An ability to act as a standalone launcher or, alternatively, as a guest launcher in conjunction with a host launcher, such as, without limitation, main battery launchers (e.g., MK 41 and MK 57 vertical launching systems, etc.).
- An architecture that requires a one-time modification to existing main battery launchers to adapt to the presence of the ALS. All future small-munitions integration/adaptation specifics are handled within the ALS itself.
- An open architecture that facilitates tailoring instantiations of the ALS for each new munitions (rather than as a multi-purpose launcher).
- A semi-permanent mechanical structure that can be installed in a cell of a host launching system, enabling repeated loading of fresh munitions as others are used (rather than replacing launched munitions with, for example, replacement canisters, as is done for the MK 41 and Mk 57 systems).
- A removable internal munitions adaptor assembly that enables use of existing USN qualified All Up Rounds ("AURs") for off-board storage, transportation, loading, and launching of munitions (rather than development and use of the ALS itself as a canister).
- Launch control electronics that interface with the host launcher's equipment and capabilities for launcher-level functionality in a multi-munitions system.
- An ability to reuse the launcher equipment (e.g., interfaces, etc.) for new munitions instantiations (rather than developing or revising equipment for this purpose).
- The use of composite materials for the exterior structure of the launcher, which provides a lightweight and encapsulated munitions compartment. This increases the amount of available internal space in the launcher and provides exhaust gas isolation from the host launcher space.
- An open and accessible electronics compartment, thereby enabling maintenance access to ALS launch control electronics while it's installed in the host launching system.

DETAILED DESCRIPTION

The adaptable launch system ("ALS") disclosed herein can be used as a standalone launcher or as a guest launcher in a main battery host system. Since the former application is the far more straightforward application, much of the disclosure below pertains to the integration of the ALS with an existing main-battery launcher.

Figure 1:
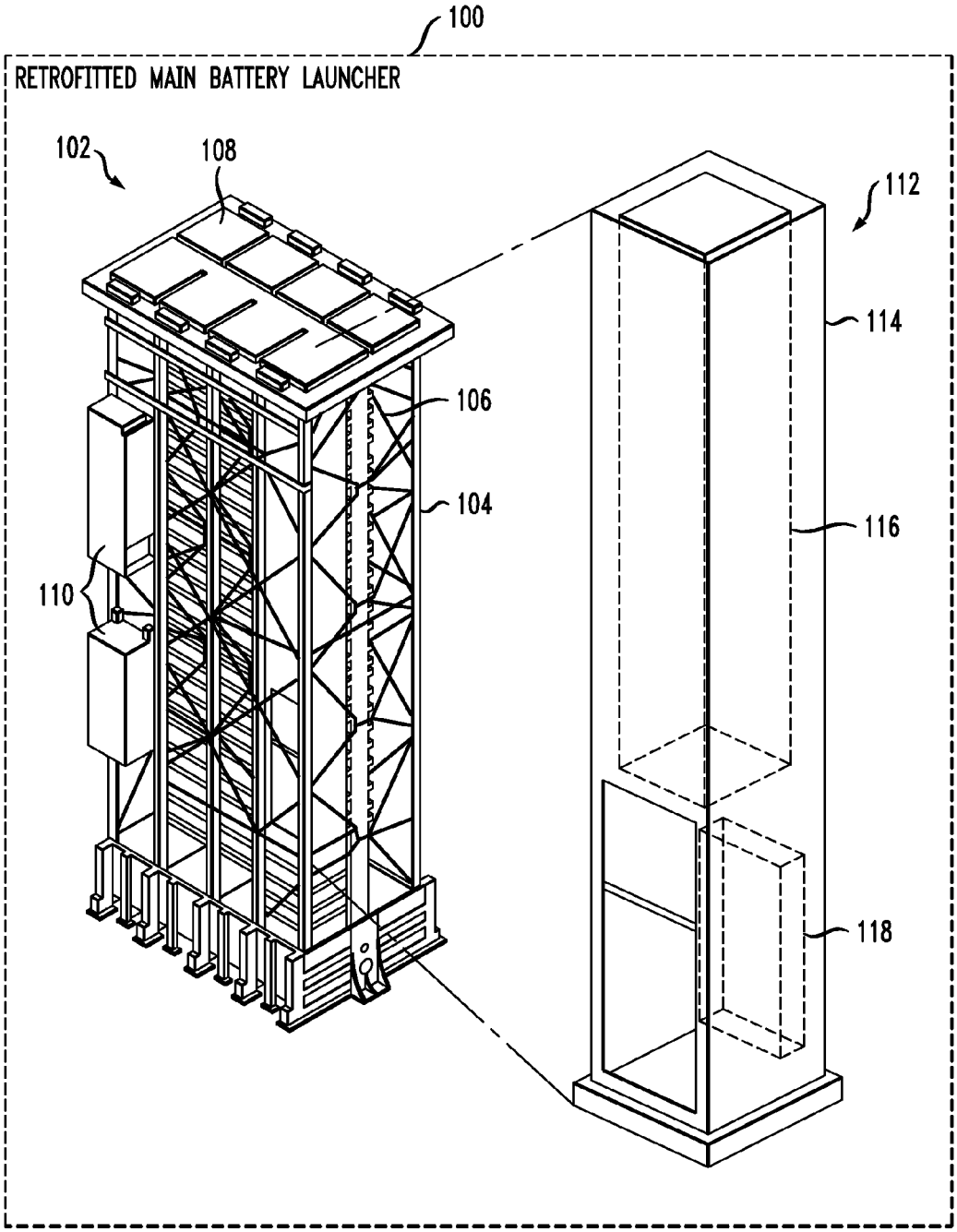
FIG. 1 depicts a host launcher, in particular the MK 41 VLS, which is retrofitted with an Adaptable Launch System in accordance with the illustrative embodiment of the invention.

FIG. 1 depicts retrofitted multi-cell launcher ("RMCL") 100 in accordance with the illustrative embodiment of the present invention. RMCL 100 includes multi-cell, multi-munition launcher ("MCL") 102 and ALS 112. In the embodiments depicted herein, MCL 102 is a MK 41 VLS main battery launcher that has been appropriately modified to operate with one or more ALS 112 units in its cells as guest launchers. In other embodiments, other host launchers (e.g., MK 57 VLS, etc.) may suitably be used as MCL 102. In conjunction with this disclosure, those skilled in the art will know how to modify a host launcher to accept ALS 112. Modifications to MCL 102 to permit operation of ALS 112 as a guest launcher include, without limitation, modification of cell deck and hatch assembly 108, modification and implementation of necessary power and data cabling, modification of the host launcher tactical software, and modification of the host launcher ancillary software. Those skilled in the art, after reading the present disclosure, will be able to make the required modifications.

As depicted in FIG. 1, MCL 102 is a fixed, vertical, multi-missile storage and firing system. The missile launcher consists of a single eight-cell missile module that is capable of launching a variety of different types of missiles. The eight-cell module comprises upright structure 104, which defines eight cells 106. In a typical MK 41 VLS unit, the cells provide vertical storage space for eight missile canisters. But in accordance with the illustrative embodiment, one or more of cells 106 receive ALS 112 unit(s).

The MK 41 VLS as MCL 102 is installed below deck, such that only deck and hatch assembly 108 at the top of the module is visible from the deck of a ship. The deck and hatch assembly protects ALS 112 (or missile canisters in a conventional MK 41 VLS) during storage and the hatches open to permit munitions launch. A plenum and uptake structure (not identified in FIG. 1) captures and vents missile exhaust gases vertically up through the module to the atmosphere through the uptake hatch.

Electronic equipment 110 monitors and controls various components of MCL 102, distributes power signals originating from outside RMCL 100 to the one or more ALS 112 units, collects control and damage control signals from ALS 112 and transmits them to appropriate authorities, and assists in the launch of munitions from ALS 112 units.

The salient features of ALS 112 depicted in FIG. 1 include enclosure 114, munitions adapter 116, and launch control electronics 118. These features are described briefly below and then in further detail in conjunction with FIGS. 2, 3, 4, and 6 later in this specification.

Enclosure 114 serves as a housing for munitions adaptor 116 and launch control electronics 118. Munitions adapter 116 is specific to the munitions that it carries. Various embodiments of munition adapter 116 are used for missiles, active decoys, and unmanned aerial vehicles ("UAVs"), as described later in conjunction with FIGS. 5A-5E.

The munitions are launched from ALS 112 under the control of their own weapon control system ("WCS"), through an instantiation of launch control electronics 118 that is tailored to that specific munition type. Launch control electronics 118 supplies electrical power to the munitions and manages the launch sequence. In most embodiments, the electrical power distribution subassembly and at least some cabling, all of which are part of the "conceptual" ALS disclosed herein, are not included in ALS 112 proper. Rather, these elements are associated with the host launcher.

Gas and green water management are provided by ALS 112, thereby avoiding the need to modify the management systems of the host launcher. The host hatch system (e.g., deck and hatch assembly 108, etc.) might require modification, as a function of munitions type, to enable venting of exhaust gases under abnormal, inadvertent, or restrained firing events.

ALS 112 is loaded into MCL 102 (when the MCL is as a MK 41 VLS) as follows. ALS 112, with munitions adapter 116 and munitions launch control electronics 118 installed, is transported to dockside in a horizontal orientation. A "tilt fixture" is used to rotate ALS 112 to a vertical orientation. A vertical "strong back" is then attached to ALS 112 and a dockside crane is used to load the ALS(s) into the designated cell(s) of MCL 102 on board a ship.

Personnel then secure ALS 112 into the cell using "dogdowns," in the same fashion as is done with conventional missile canisters. The umbilical and other required cables are then attached. As part of this initial installation, the MCL's standard hatch is replaced with a hatch that is suitable for the munitions within ALS 112, to the extent that the ALS is loaded with munitions that are not normally fired from a conventional version of the MCL.

ALS 112 is intended as a semi-permanent installation in a cell of MCL 102. Although ALS 112 can be removed or relocated if requirements change, it will typically remain in place and will be reloaded with fresh rounds of munitions as previous rounds are launched or otherwise removed. This is in contrast to conventionally used canisters, which are removed from a launcher such as the MK 41 VLS after the munition formerly stored therein is launched and then replaced with a fresh missile-bearing canister. Again, the ALS is not analogous to a canistered munition.

Figure 2:
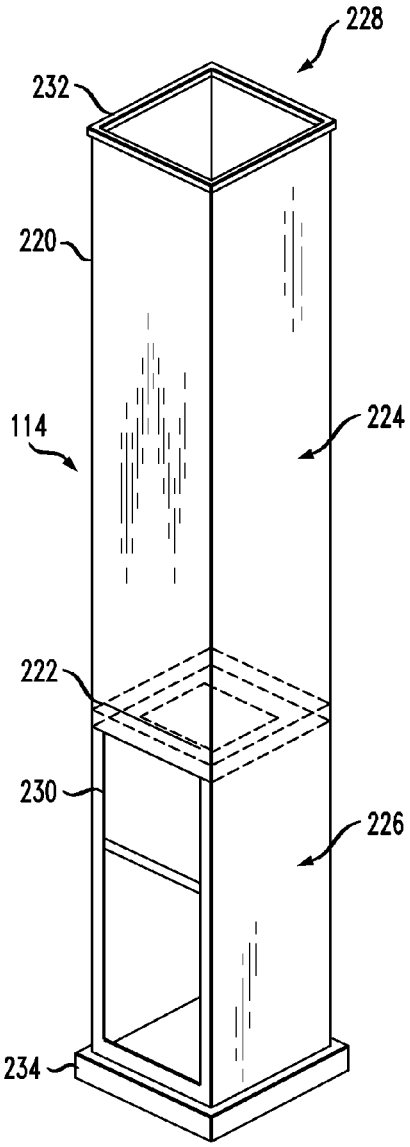
FIG. 2 depicts the outer structure of the ALS of FIG. 1.
Figure 3:
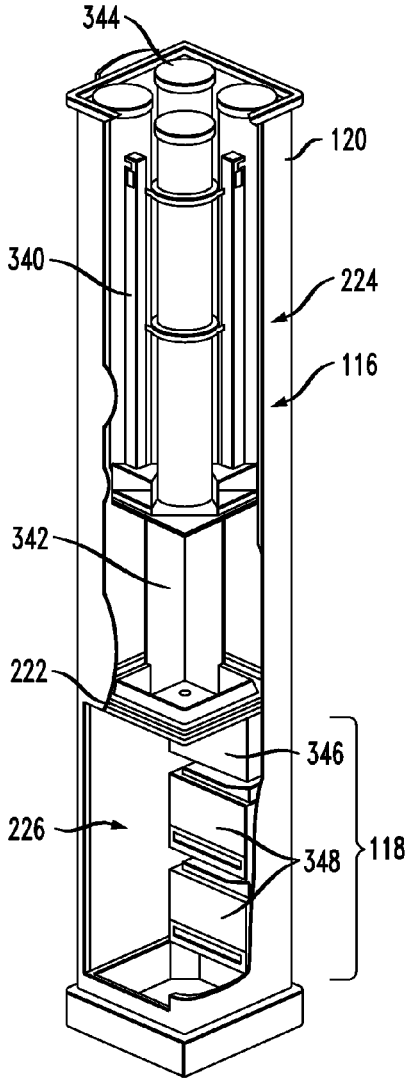
FIG. 3 depicts internals of the ALS of FIG. 1, showing a munitions adaptor and munitions in a munitions compartment and launch control electronics in an electronics compartment.

FIG. 2 depicts further detail of enclosure 114 and FIG. 3 depicts further detail regarding the positioning of munitions adaptor 116 and launch control electronics 118 within the enclosure.

Referring now to FIG. 2, enclosure 114 comprises shell 220, sealing bulkhead 222, munitions compartment 224, electronics compartment 226, electronics access way 230, top frame/seal 232, and bottom frame 234.

Shell 220 meets the physical requirements (e.g., size, shape, etc.) of a Mk41 canister. Shell 220 is formed from a composite material that meets appropriate standards (e.g., MIL-STD 2031, DDS 078-1, etc.). Shell 220 is sized to accommodate both the tactical length and strike length launcher applications. For some "stand alone" embodiments of ALS 112, some of launch control electronics 118 are located outside of shell 220 due to size constraints.

Sealing bulkhead 222 (shown in phantom in FIG. 2) separates munitions compartment 224, which houses munitions adapter 116 (FIGS. 1 and 3) from electronics compartment 226, which houses launch control electronics 118 (FIGS. 1 and 3). The sealing bulkhead serves as a part of the gas management system, preventing munitions exhaust gases from entering electronics compartment 226 and the launcher space of the ship.

ALS 112 does not incorporate a forward fly-through cover nor is it otherwise sealed for transport and storage (since it does not serve as a canister for munitions). In fact, ALS 112 does not contain munitions until they are loaded therein onboard the ship, as described later in this specification. As a consequence, top frame and module seal 232, which are disposed at upper end 228 of enclosure 114, cooperate with deck and hatch assembly 108 of MCL 102 to create a seal to prevent exhaust gases from entering the launcher space of the ship.

Electronics compartment 226 is not sealed. Access to the electronics compartment is provided by electronics access way 230. The electronics access way provides the following three functions when ALS 112 is installed in MCL 102.

1. It provides access to electronics compartment 226 for maintenance of electronics.
2. It provides access to secure the bottom of munitions adapter 116 to the bulkhead 222 during loading operations.
3. It provides access for electrical connection between launch control electronics 118 and the munitions contained in munitions compartment 224.

Referring now to FIG. 3, munitions adapter 116, which is located in munitions compartment 224, includes munitions-specific frame assembly 340 and munitions extension assembly 342. Launch control electronics 118, which is located in electronics compartment 226, comprises launch control module 346 and launch control electronics 348.

Munitions-specific frame assembly 340 receives canistered munitions 344. In this particular embodiment, frame assembly 340 is a quad-pack frame assembly that receives four canistered munitions 344. In the pictured embodiment, the canistered munitions are NULKA active decoys. As previously mentioned, the configuration of munitions-specific frame assembly 340 varies with the particular munitions being used (see, e.g., FIGS. 5A through 5E). Munitions-specific frame assembly 340 is described in further detail in conjunction with FIG. 4.

Munitions extension assembly 342 enables ALS 112 to accommodate munitions of different sizes. Specifically, the length of the munitions extension assembly is varied, based on the length of the munitions type being used, to fill any excess length in munitions compartment 224. In most embodiments, the length of any particular munitions extension assembly 342 is not variable; rather, a plurality of different-length munitions extension assemblies are fabricated to accommodate differences in munitions length. The base of munitions extension assembly 342 seals against sealing bulkhead 222 to ensure that electronics compartment 226 is not exposed to exhaust gases that are generated during launch or restrained firing of munitions 344. Munitions extension assembly 342 will be described further in conjunction with FIG. 6.

Figure 4:
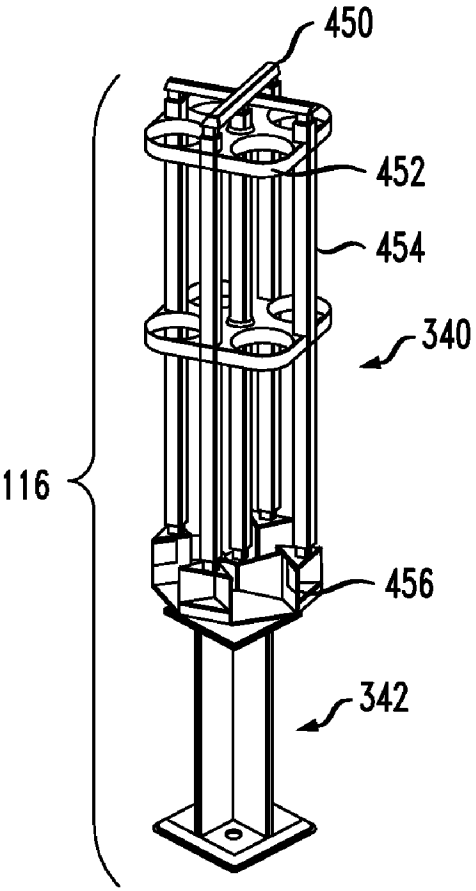
FIG. 4 depicts further detail of the munitions adaptor of FIG. 3.

FIG. 4 depicts additional details of munitions-specific frame assembly 340 of munitions adaptor 116. In the embodiment shown in FIG. 4, munitions adaptor 116 includes top brace 450, retainers 452, upright supports 454, and base 456.

In this embodiment, base 456 receives the bottom of the munitions canisters (not depicted in FIG. 4) that are ultimately loaded into munitions-specific frame assembly 340. Retainers 452 stabilize the munitions in the frame assembly. Upright supports 454 couple top brace 450 to base 456 to provide rigidity to munitions-specific frame assembly 340.

Figure 5A:
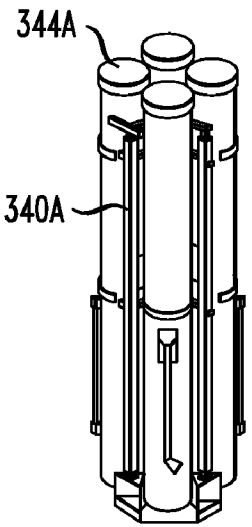
FIGS. 5A-5E depicts various munition-specific embodiments of the munitions adaptor.
Figure 5B:
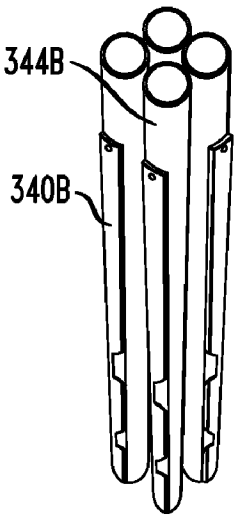
Figure 5C:
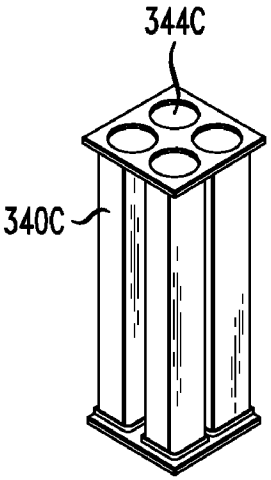
Figure 5D:
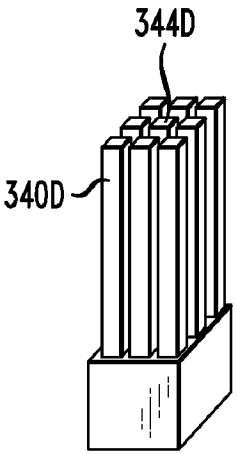
Figure 5E:
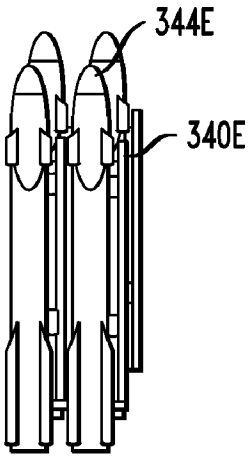

FIGS. 5A through 5E depict five different embodiments of munitions-specific frame assembly 340 for use with five different types of munitions. FIG. 5A depicts munitions-specific frame assembly 340A for use with NULKA active decoys 344A (see also, FIG. 4). FIG. 5B depicts munitions-specific frame assembly 340B for use with Rolling Airframe Missiles (RAM) 344B. FIG. 5C depicts munitions-specific frame assembly 340C for use with Precision Attack Missiles (PAM) 344C. FIG. 5D depicts munitions-specific frame assembly 340D for use with unmanned aerial vehicles (UAVs) 344D. FIG. 5E depicts munitions-specific frame assembly 340E for use with Hellfire Missiles 344E. Munitions-specific frame assemblies 340A through 340C and 340E are quad packs; that is, they accept four canistered munitions.

Figure 6:
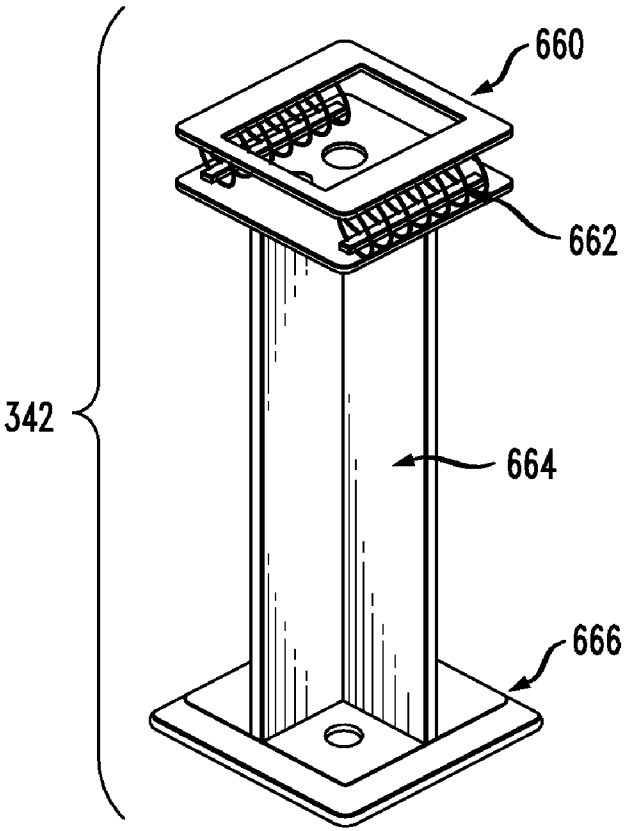
FIG. 6 depicts further detail of the munitions adaptor of FIG. 4, providing further details of a munitions extension weldment.

FIG. 6 depicts further detail of munitions extension assembly 342. As shown in FIG. 6, the munitions extension assembly includes interface plate 660, vertical shock isolators 662, extension member 664, and base 666.

Munitions extension assembly 342 serves several purposes in addition to providing ALS 112 with a capability to accommodate munitions of different lengths (as a function of the length of extension member 664). In particular, vertical shock isolators 662 of the munitions extension assembly provides shock protection for the munitions within munition-specific frame assembly 340. Also, various electrical connectors are provided near interface plate 660 and base 666 for creating electrical connection, in conjunction with cables (not shown), between launch control electronics 118 and munitions 344 in frame assembly 340. A seal plate (not depicted) that is positioned between sealing bulkhead 222 and base 666 prevents leakage of exhaust gases and of any green water intrusion due to an open or leaking hatch.

In most embodiments, munitions used in conjunction with ALS 112 have canisters and will use the canister and all-up-round ("AUR") configuration for transport, storage, and launch capabilities. This eliminates development and recurring costs for integrating canisters into ALS 112. The ALS accepts the AUR; it does not itself function as an AUR.

The following provides an example of a process for loading NULKA all-up-rounds 344A (see, e.g., FIG. 5A) in ALS 112. The NULKA Electronic Decoy Cartridge 334A is not a shipping container; an additional container is used for shipping. As a consequence, to transport the NULKA AURs to the ship, each NULKA AUR is loaded into a shipping container. The shipping containers are transported to the deck of the ship where the NULKA AURs are removed.

Personnel will disconnect munitions adapter 116 from enclosure 114 and, using a dock-side crane, will partially extract the munitions adapter from ALS 112 that is in a cell of MCL 102. (The munitions adapter is extracted through top 228 (see FIG. 2) of enclosure 114.) Munitions adapter is extracted at least to the point at which munitions specific frame assembly 340 clears the deck of the ship. Personnel will then remove any expended, duded, etc., AURs and then load fresh AURs into frame assembly 340 of munitions adapter 116.

After loading is complete, the dock-side crane will lower munitions adapter 116 back into enclosure 114 (which is still in the MCL 102). Personnel reconnect the munitions adapter to enclosure 114 and also connect the munitions adapter to launch control electronics 118.

Returning to the discussion of FIG. 2, launch control electronics 118 are disposed in electronic compartment 226 beneath sealing bulkhead 222. In the illustrative embodiment, the launch control electronics includes launch control module 346 and munition specific electronics 348.

Munition specific electronics 348 are typically the same units as would be supplied for a specific munition in an existing launcher. For example, in the case of a NULKA instantiation of launch control electronics 118, munition specific electronics 348 are two MK 174 processor power supplies, as are used for NULKA rounds in the MK 53 DLS deck-mounted, mortar-type countermeasure system. Munition specific electronics 348 provide power, data, and ordnance activation control to the munitions and also perform limited launch control functions.

Launch control module 346 coordinates control/communications between the munition's weapon control system, munition specific electronics 348, and the host launcher (e.g., MK 41, etc.). Launch control module 346 is developed for use with a particular munitions type. It is then re-used for other types of munitions by making suitable software and hardware modifications. The modifications pertain to ALS 112, not the host launcher.

Host/Guest Communications. Communications between host launcher MCL 102 and ALS 112 are described below for the case of a MK 41 VLS as the host launcher and a NULKA instantiation of ALS.

A NULKA MK 24 Decoy Launching Processor communicates directly with launch control module 346, which controls the transfer of existing RS-422 (serial bus) messages between the MK 24 Decoy Launching Processor and processor power supplies 348. Launch control module 346 coordinates hatch operations and launch coordination activities with MCL 102.

The identification code of ALS 112 is communicated to launch sequencer 110 and launch control unit of MCL 102.

Launch Operations. When used as a guest launcher, ALS 112 continues to perform most tasks related to launching its munitions, but it will coordinate with the host—MCL 102—for functionality that is provided by the host. Such functions are those for which ALS 112 utilizes equipment provided by MCL 102 and that involve operational considerations that must be addressed at a higher, host-launcher level. Such functions include, without limitiation:

Operational readiness coordination;

Hatch management;

Launch coordination with other host and ship activities; and

Self, host, and hazard management.

Inventory Control and Launch Process Initiation. ALS 112 provides an ID to MCL 102 through an umbilical cable. This ID informs the MCL that the particular cell is occupied by ALS 112; it does not specify the munitions type that is contained in the ALS. As a consequence, when MCL 102 is apprised of the presence of ALS 112 in one or more of its cells, the MCL will be required at appropriate times to query ALS 112 for munitions-specific information (e.g., munitions warfare type—AAW, ASW, SUW, others, launch rate deltas, etc.). In some embodiments, this is accomplished via messages between ALS 112 and MCL 102. These messages and related control functionality provides flexibility to handle all future munitions for use with ALS 112, thereby reducing related costs for integrating such munitions.

To initiate the launch process, the weapon control system for the munitions in ALS 112 coordinates selection of the desired cell and (in the case of multiple munitions within the cell) the particular munition within the cell. Although this process is driven by the weapons control system, MCL 102 will typically have other ongoing launch activities that might prevent use of the preferred munitions selection due to commitment of power supplies, etc., or issues associated with disabled equipment, ablative issues, and the like.

Launch Sequencing. Message communications between ALS 112 and MCL 102 is between launch control electronics 118 in the ALS and the launch control unit in MCL 102. Some aspects of the launch sequence will be variable as a function of munitions type. In one category of munitions, the sequence involves the munition's weapon control system, launch control electronics 118, and the munition (for missile preparation and final ignition and egress), but with no coordination with MCL 102 until the end of a subsequence. In another category, it involves processes internal to MCL 102, but with no coordination with ALS 112 until the end of a subsequence. Coordination between MCL 102 and ALS 112 is required only at the completion of each subsequence.

In some embodiments, there are only five such coordination points between ALS 112 and MCL 102. As a consequence, the launch-sequence integration of the ALS with MCL 102 can be a one-time task for all subsequent munitions. The coordination points for any munition to be launched by ALS 112 in a vertical launch system will be:

(1) Launch control electronics 118 in ALS 112 tells the launch control unit in MCL 102 that it has been selected by the appropriate weapon control system to launch a munition.

(2) The launch control unit in MCL 102 tells launch control electronics 118 that MCL 102 has coordinated the cell for launch operations and that launch control electronics 118 may proceed with preparations.

(3) Launch control electronics 118 tells the launch control unit in MCL 102 that the munition is ready to be launched and requests permission to launch.

(4) The launch control unit in MCL 102 gives launch control electronics 118 the command to launch the munition, and (5) Launch control electronics 118 tells the launch control unit in MCL 102 when the munition is away so that MCL 102 may close the hatch.

Some of the munition-specific processes, for example restraint release, are presently done in the host launcher (e.g., Mk41 VLS). But this varies for each munition, which adds to integration costs. By locating these munition-specific functions in ALS 112, the features will become part of the munition-specific instantiation of ALS 112, and will require no further modifications to the host (i.e., MCL 102) following the first instantiation.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An apparatus comprising:

a single cell vertical launch system that is suitable for:

(i) use as a guest launcher within a host launcher, and (ii) launching one or more canistered munitions, the single cell vertical launch system comprising:

(A) an enclosure having a sealing bulkhead that separates the enclosure into a munitions compartment and an electronics compartment, wherein the enclosure is dimensioned and arranged to be received by a cell within the host launcher;

(B) a munitions adapter disposed in the munitions compartment, wherein the munitions adapter is munition-specific and receives the canistered munition (C) launch control electronics disposed at least in part in the electronics compartment, wherein the launch control electronics is munition-specific and coordinates at least some control and communications between the single cell vertical launch system and the host launcher.

2. The apparatus of claim 1 further comprising the host launcher, wherein the host launcher has a plurality of cells, and wherein the single cell vertical launch system is disposed in one of the cells.

3. The apparatus of claim 2 wherein the host launcher is one of a MK 41 VLS and a MK 57 VLS.

4. The apparatus of claim 2 wherein the electronics compartment comprises an access way, wherein the access way provides access to the electronics compartment when the launch system is installed in the cell of the host launcher.

5. The apparatus of claim 1 wherein a top of the launch system is open until the top seals against a hatch and deck assembly of the host launcher.

6. The apparatus of claim 1 wherein the canistered munition is a missile.

7. The apparatus of claim 1 wherein the canistered munition is an unmanned aerial vehicle.

8. The apparatus of claim 1 wherein the canistered munition is an active decoy.

9. The apparatus of claim 1 wherein the canistered munition is an all-up-round.

10. The apparatus of claim 6 wherein the missile is selected from the group consisting of a rolling airframe missile, a precision attack missile, and a Hellfire missile.

11. The apparatus of claim 1 wherein the launch control electronics comprises:

munition-specific electronics for providing power, data, and ordnance activation to the munition and for performing at least some launch control functions; and a launch control module for coordinating communications between a weapon control system of the munition and the munition-specific electronics.

12. The apparatus of claim 1 wherein the received canistered munition is one of either (i) a first canistered munition or (ii) a second canistered munition that differ from one another in at least one characteristic selected from length, diameter, or shape, and further wherein the structure of the munitions adapter is changeable as a function of whether the received canistered munition is the first canistered munitions or the second canistered munition.

13. A single cell vertical launch system comprising:

(A) an enclosure having a sealing bulkhead that physically segregates the enclosure into a munitions compartment and an electronics compartment, wherein the enclosure is dimensioned and arranged to be received by a cell within a host launcher;

(B) a munitions adapter, wherein the munitions adapter is disposed in the munitions compartment, and wherein:

(i) the munitions adapter receives canistered munitions; and (ii) a structure of the munitions adapter is configured as a function of whether the canistered munitions are first canistered munitions or second canistered munitions, wherein the first canistered munitions and the second canistered munitions differ from one another in at least one characteristic selected from length, diameter, or shape of the munition; and (C) launch control electronics adapted to coordinate at least some control and communications between the single cell vertical launch system and the host launcher, wherein the launch control electronics is disposed in the electronics compartment, and wherein the launch control electronics is configured as a function of whether the canistered munitions are first canistered munitions or second canistered munitions;

wherein the single cell vertical launch system is suitable for:

(i) use as a guest launcher within the host launcher, and (ii) launching one or more of the canistered munitions.

14. The single cell vertical launch system of claim 13 wherein:

when the munitions adapter receives the first canistered munitions, the munitions adapter comprises a first munitions-specific frame assembly having a first configuration suitable for receiving the first canistered munitions; and when the munitions adapter receives the second canistered munitions, the munitions adapter comprises a second munitions-specific frame assembly having a second configuration suitable for receiving the second canistered munitions, wherein the first configuration and the second configuration are different from one another.

15. The single cell vertical launch system of claim 13 wherein the first canistered munitions and the second canistered munitions differ from one another in length, and further wherein:

when the munitions adapter receives the first canistered munitions, the munitions adapter comprises a first munitions extension assembly having a first length related to the length of the first canistered munitions; and when the munitions adapter receives the second canistered munitions, the munitions adapter comprises a second munitions extension assembly having a second length related to the length of the second canistered munitions, wherein the first length and the second length are different from one another.

16. The single cell vertical launch system of claim 13 wherein:

when the munitions adapter receives the first canistered munitions, the launch control electronics comprises a first instantiation that is suitable for controlling launch of the first canistered munitions; and when the munitions adapter receives the second canistered munitions, the launch control electronics comprises a second instantiation that is suitable for controlling launch of the second canistered munitions, wherein the first instantiation and the second instantiation differ from one another.

17. An apparatus comprising:

a single cell vertical launch system that is suitable for:

(i) use as a guest launcher within a host launcher, and (ii) launching one or more canistered munitions, the single cell vertical launch system comprising:

(A) an enclosure having a sealing bulkhead that separates the enclosure into a munitions compartment and an electronics compartment, wherein the enclosure is dimensioned and arranged to be received by a cell within the host launcher;

(B) a munitions adapter disposed in the munitions compartment, wherein the munitions adapter receives the canistered munition, and wherein the received canistered munition is one of either a first canistered munition or a second canistered munition that differ from one another in at least one characteristic selected from length, diameter, or shape, and further wherein the structure of the munitions adapter is changeable as a function of whether the received canistered munition is the first canistered munitions or the second canistered munition; and (C) launch control electronics that coordinates at least some control and communications between the launch system and the host launcher, wherein the launch control electronics is disposed in the electronics compartment and has a configuration that depends on whether the canistered munition is the first canistered munition or the second canistered munition.

18. The apparatus of claim 17 further comprising the host launcher, wherein the host launcher has a plurality of cells, and wherein the single cell vertical launch system is disposed in one of the cells.

* * * * *